US008491023B2

(12) United States Patent
Brannaman et al.

(10) Patent No.: US 8,491,023 B2
(45) Date of Patent: Jul. 23, 2013

(54) DOOR LOCK ASSEMBLY

(75) Inventors: Rick L. Brannaman, Monument, CO (US); Eric E. Fishencord, Colorado Springs, CO (US); Sajil J. Mathachan, Dharwad (IN); Michael D. Rainone, Palestine, TX (US); Michael S. Justis, New Bern, NC (US); Sachin J. Keni, Bangalore (IN); Milind A. Ghumre, Bangalore (IN)

(73) Assignee: Schlage Lock Company LLC, Indianapolis, IN (US)

( * ) Notice: Subject to any disclaimer, the term of this patent is extended or adjusted under 35 U.S.C. 154(b) by 1688 days.

(21) Appl. No.: 11/849,620

(22) Filed: Sep. 4, 2007

(65) Prior Publication Data

US 2009/0056392 A1 Mar. 5, 2009

(51) Int. Cl.
*E05B 1/00* (2006.01)

(52) U.S. Cl.
USPC ..... 292/347; 292/336.5; 292/336.3

(58) Field of Classification Search
USPC ..... 292/347, 336.5, 336.3; 70/223–224, 70/472
See application file for complete search history.

(56) References Cited

U.S. PATENT DOCUMENTS

| | | | | |
|---|---|---|---|---|
| 2,739,472 | A | | 3/1956 | North et al. |
| 2,814,194 | A | | 11/1957 | North et al. |
| 2,950,615 | A | | 8/1960 | Schlage et al. |
| 3,819,214 | A | | 6/1974 | Hart et al. |
| 4,470,278 | A | | 9/1984 | Hale et al. |
| 4,838,053 | A | | 6/1989 | Shen |
| 4,966,399 | A | | 10/1990 | Lin |
| 5,284,372 | A | | 2/1994 | Lin |
| 5,301,526 | A | | 4/1994 | Fann et al. |
| 5,460,417 | A | | 10/1995 | Zuckerman |
| 5,784,909 | A | | 7/1998 | Huang |
| 5,809,815 | A | * | 9/1998 | Lee ..... 70/472 |
| 5,816,086 | A | | 10/1998 | Russell, IV |
| 5,934,117 | A | * | 8/1999 | Shen ..... 70/224 |
| 5,941,108 | A | | 8/1999 | Shen |
| 5,992,189 | A | | 11/1999 | McCaa |
| 6,021,654 | A | | 2/2000 | McCaa |
| 6,038,894 | A | | 3/2000 | Hu |
| 6,141,998 | A | | 11/2000 | Seo |

(Continued)

OTHER PUBLICATIONS

PCT/US2008/075097 International Search Report and Written Opinion dated Dec. 19, 2008 (13 pages).

(Continued)

*Primary Examiner* — Carlos Lugo
*Assistant Examiner* — Mark Williams
(74) *Attorney, Agent, or Firm* — Michael Best & Friedrich LLP

(57) ABSTRACT

A lock assembly for use with a latch movable from an extended position to a retracted position, and the lock assembly includes an interior assembly and an exterior assembly. The interior assembly includes an interior handle manually movable to retract the latch and a locking member manually operable such that the locking member is movable from an unlocked position to a locked position. The exterior assembly includes an exterior handle manually operable to retract the latch when the locking member is in the unlocked position and inoperable to retract the latch when the locking member is in the locked position. The exterior assembly further includes a biasing member that biases the locking member toward the unlocked position. When the locking member is in the locked position, movement of the interior handle to retract the latch causes the biasing member to move the locking member to the unlocked position.

27 Claims, 13 Drawing Sheets

U.S. PATENT DOCUMENTS

| | | | | |
|---|---|---|---|---|
| 6,216,500 | B1 | 4/2001 | Kang | |
| 6,279,360 | B1 | 8/2001 | Shen | |
| 6,351,976 | B1 | 3/2002 | Chen | |
| 6,357,270 | B1 | 3/2002 | Vazquez | |
| 6,425,273 | B1 | 7/2002 | Kim et al. | |
| 6,553,799 | B2 | 4/2003 | Bates et al. | |
| 6,615,630 | B2 | 9/2003 | Wu et al. | |
| 6,623,053 | B1 | 9/2003 | Hwang | |
| 6,807,833 | B1 * | 10/2004 | Huang et al. | 70/107 |
| 6,860,529 | B2 | 3/2005 | Chong et al. | |
| 6,929,290 | B2 | 8/2005 | Don | |
| 7,100,407 | B2 * | 9/2006 | Chen | 70/224 |
| 7,559,219 | B2 * | 7/2009 | Chen | 70/224 |
| 2003/0056556 | A1 | 3/2003 | Park et al. | |
| 2004/0144143 | A1 | 7/2004 | Don | |

OTHER PUBLICATIONS

Pending U.S. Appl. No. 11/849,575, filed Sep. 4, 2007.

* cited by examiner

DOOR LOCK ASSEMBLY

BACKGROUND

The present invention relates to locks, and more particularly to tubular locks for doors.

Door locks typically include an interior assembly, an exterior assembly, and a latch assembly. When the door is closed the latch assembly engages a pocket or recess formed in a frame of the door to hold the door in the closed position. Generally, in tubular lock assemblies the interior and exterior assemblies both include a handle that is rotatable to retract the latch so that the door can be opened. Often, the interior assembly further includes a locking member having a push button or a turn button that is manually operable to lock the lock assembly. When the lock assembly is locked, the exterior handle is inoperable to retract the latch and the door cannot be opened using the exterior handle.

SUMMARY

When the lock assembly is locked and the door is closed, it is desirable for the user to be able to exit the door by rotating the interior handle without having to manually operate the push button or turn button locking member. Such a feature is often referred to as "emergency egress" or "one-step exit." If the lock assembly includes emergency egress it is also desirable that the lock assembly becomes unlocked so that the user does not become locked out of the door after the user exits and the door closes. Such a feature is often referred to as a "non-lockout" feature and in prior tubular locks the non-lock out feature has been accomplished by having the user unlock the lock assembly by turning the turn button of the locking member before the user exits. However, if the user has to rotate the turn button to exit, the lock assembly does not have emergency egress.

In one embodiment, the invention provides a lock assembly for use with a latch movable from an extended position to a retracted position. The lock assembly includes an interior assembly and an exterior assembly. The interior assembly includes an interior handle manually movable to retract the latch, and a locking member manually operable such that the locking member is movable from an unlocked position to a locked position. The exterior assembly includes an exterior handle manually operable to retract the latch when the locking member is in the unlocked position and inoperable to retract the latch when the locking member is in the locked position. The exterior assembly further includes a biasing member that biases the locking member toward the unlocked position, and when the locking member is in the locked position, movement of the interior handle to retract the latch causes the biasing member to move the locking member to the unlocked position.

In another embodiment, the invention provides a lock assembly for use with a latch movable from an extended position to a retracted position. The lock assembly includes an interior assembly and an exterior assembly. The interior assembly includes an interior handle manually operable to retract the latch, and a turn button manually rotatable with respect to the handle from a locked position to an unlocked position. The exterior assembly includes an exterior handle manually operable to retract the latch when the turn button is in the unlocked position and inoperable to retract the latch when the turn button is in the locked position. When the turn button is in the locked position movement of the interior handle to retract the latch causes the turn button to move to the unlocked position.

In yet another embodiment, the invention provides a lock assembly for use with a latch movable from an extended position to a retracted position. The lock assembly includes an interior assembly and an exterior assembly. The interior assembly includes an interior handle manually operable to retract the latch, and a locking member manually operable such that the locking member is movable from an unlocked position and a locked position. The exterior assembly includes an exterior handle manually operable to retract the latch when the locking member is in the unlocked position and inoperable to retract the latch when the locking member is in the locked position. The lock assembly further includes a torsion spring that biases the locking member toward the unlocked position. When the locking member is in the locked position, movement of the interior handle to retract the latch causes the torsion spring to rotate the locking member to the unlocked position.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
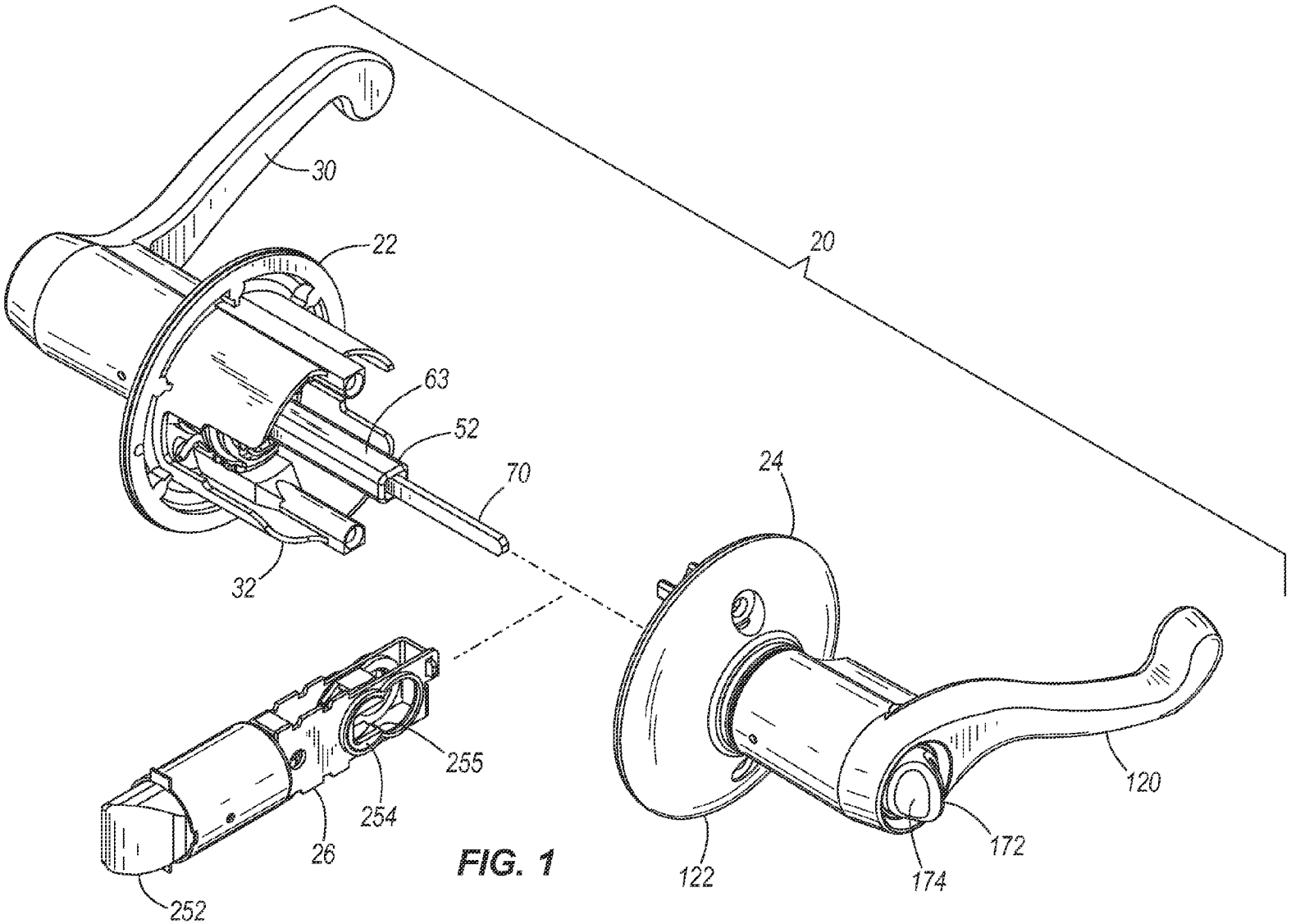
FIG. 1 is a partially exploded view of a lock assembly embodying the present invention.

FIG. 1 illustrates a tubular lock assembly 20 that includes an exterior assembly 22, an interior assembly 24, and a latch assembly 26. The tubular lock assembly 20 is for use with a door (not illustrated), the exterior assembly 22 is coupled to and extends from an exterior surface of the door, and the interior assembly 24 is coupled to and extends from an interior surface of the door. The latch 26 is located between the exterior assembly 22 and the interior assembly 24 in a bore of the door such that the latch 26 engages a pocket, often defined by a strike plate, in a frame of the door to hold the door in the closed position.

Figure 2:
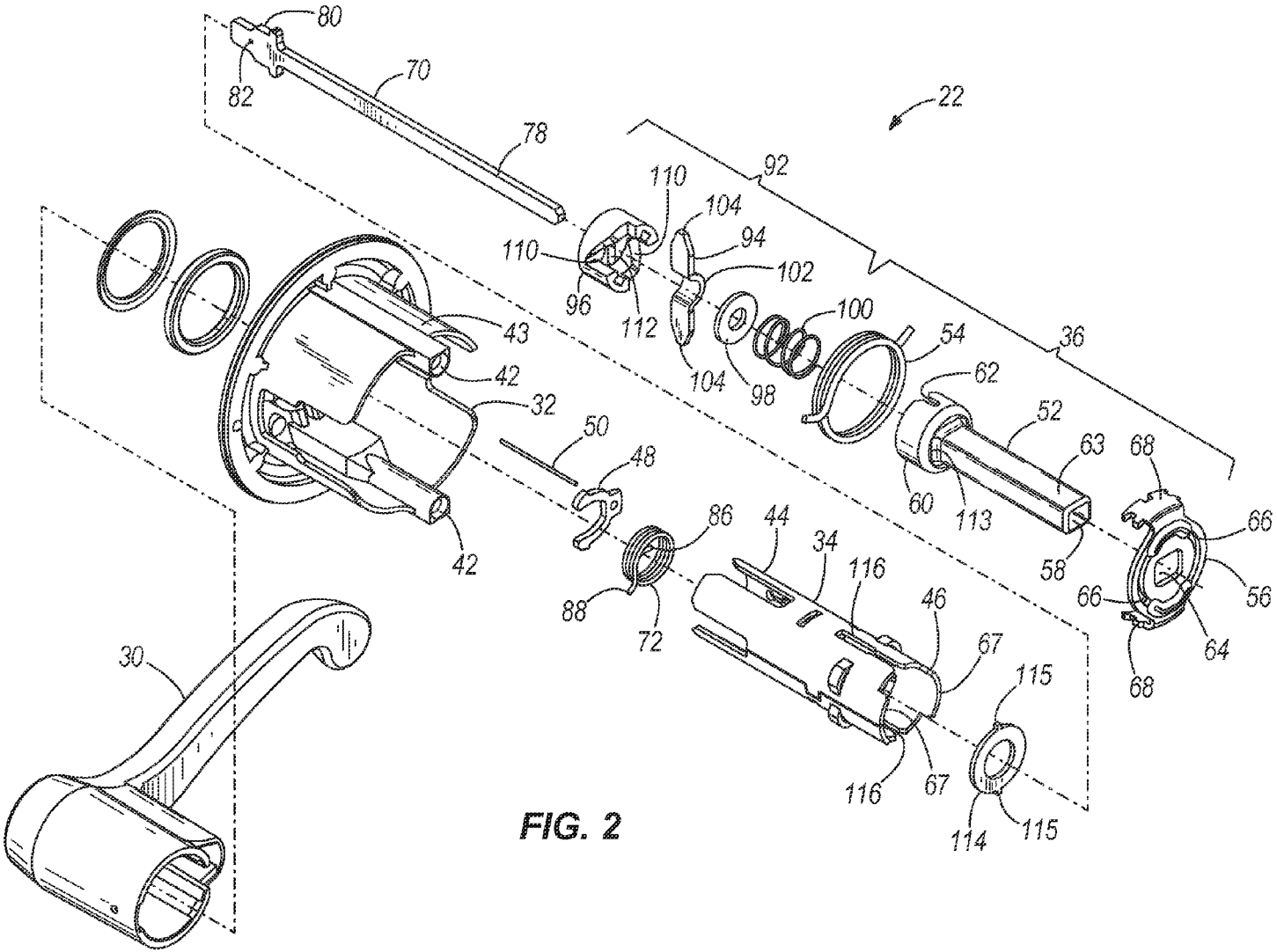
FIG. 2 is an exploded view of an exterior assembly of the lock assembly of FIG. 1.

Referring to FIG. 2, the exterior assembly 22 includes an exterior handle 30, an exterior chassis 32, an exterior spindle 34, and an exterior latch retractor assembly 36. The exterior chassis 32 includes mounting apertures 42 that receive fasteners to couple the exterior assembly 22 to the door and to the interior assembly 24 (FIG. 1). The exterior chassis 32 further includes a cylindrical portion 43 that is received in a bore of the door to couple the chassis 32 to the door. In construction, the cylindrical portion 43 is received in the bore of the door using an interference fit such that the chassis 32 is held substantially fixed with respect to the door.

The exterior spindle 34 is substantially cylindrical and hollow and includes a first or outer end portion 44 and a second or inner end portion 46. While not visible in FIG. 2, the chassis 32 includes a central aperture through which the outer end portion 44 of the spindle 34 extends when the exterior assembly 22 is assembly. As would be understood by one of skill in the art, a clip 48 and a clip biasing member 50 are utilized to couple the exterior handle 30 to the exterior spindle 34 adjacent the outer end portion 44 of the exterior spindle 34 such that the exterior handle 30 and the exterior spindle 34 are coupled for rotation together with respect to the exterior chassis 32. The inner end portion 46 of the spindle 34 includes arcuate projections 51 that extend from the inner end portion 46 of the exterior spindle 34.

The exterior latch retractor assembly 36 includes a latch actuator or tube 52, an exterior handle biasing member 54, and a latch retractor 56. The tube 52 defines a tube aperture 58 and an enlarged hollow end portion 60 having a slot 62. An inner end portion 63 of the tube 52 has a non-circular and substantially square cross-section. While only one slot 62 is visible in FIG. 2, the tube includes a second slot directly across from the visible slot 62 in the enlarged end portion 60 of the tube 52.

The latch retractor 56 includes a tube receiving aperture 64, spindle receiving apertures 66, and projections 68. The tube receiving aperture 64 has a shape that is complimentary to the inner end portion 63 of the tube 52 and is sized such that the inner end portion of the tube 52 can extend through the tube receiving aperture 64, and yet rotation of the latch retractor 56 will rotate the tube 52. The spindle receiving apertures 66 are arcuate apertures that partially surround the tube receiving aperture 64. The spindle receiving aperture 66 are complimentary to the arcuate projections 51 of the inner end portion 46 of the spindle 34. Therefore, the arcuate apertures 66 of the latch retractor 56 each receive one of the arcuate projections 51 of the spindle 34 such that rotation of the spindle 34 produces a corresponding rotation of the latch retractor 56. As would be understood by one of skill in the art, the exterior handle biasing member 54, which is a torsion spring in the illustrated construction, is directly coupled to the chassis 32 and to the exterior latch retractor 56 using the projections 68 of the latch retractor 56. The exterior handle spring 54 rotationally biases the exterior handle 30 into the position illustrated in FIG. 1.

Figure 12:
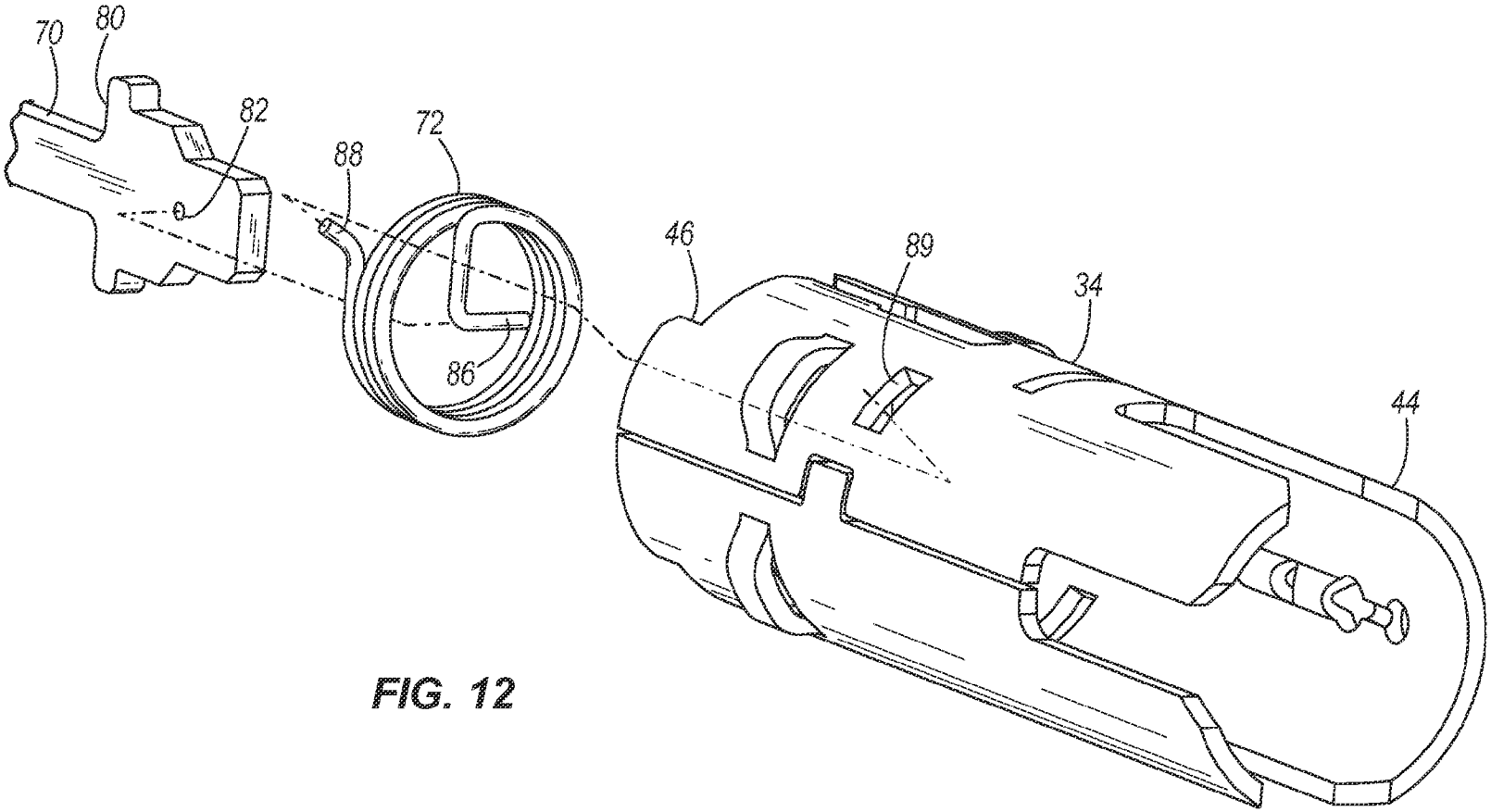
FIG. 12 is an exploded view of a portion of the exterior assembly of the lock assembly of FIG. 1.
Figure 13:
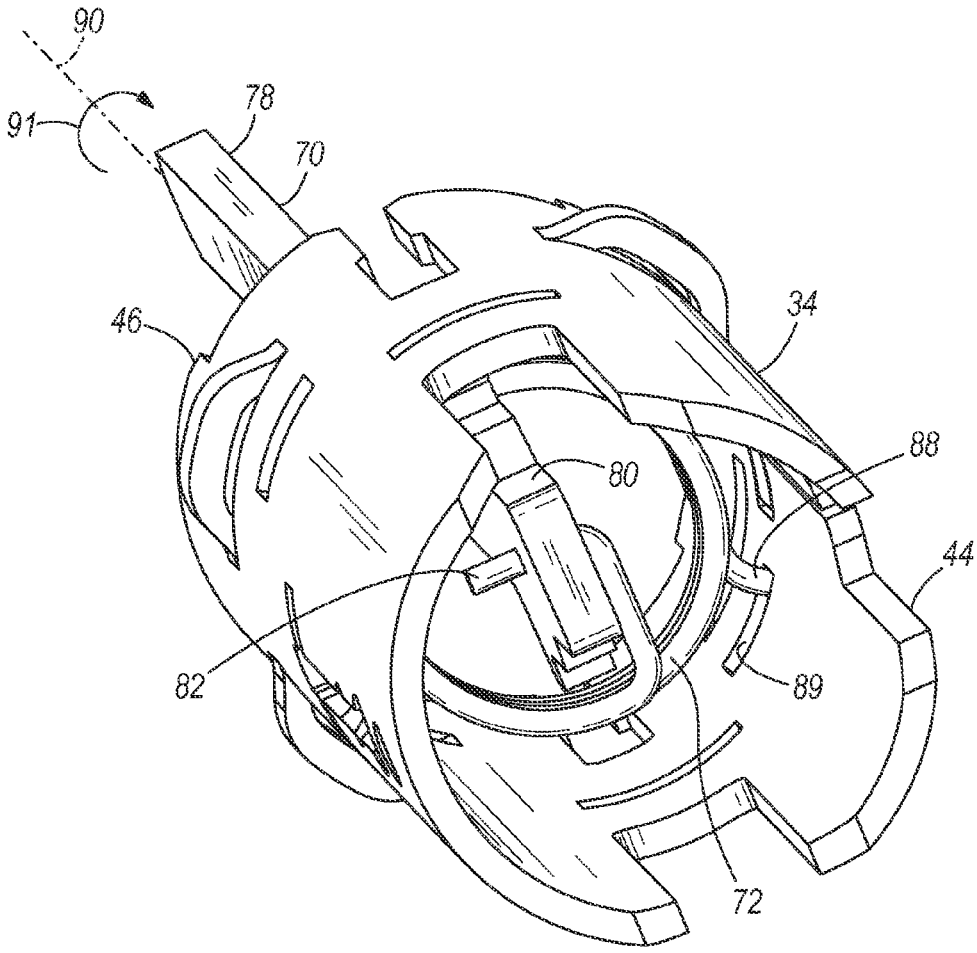
FIG. 13 is a perspective view of the portion of the exterior assembly of FIG. 12 assembled and rotated from the position illustrated in FIG. 12.

The exterior assembly 22 further includes a driver 70 and a driver biasing member 72. The driver 70 includes an elongated portion 78 and an enlarged end portion 80. When the exterior assembly 22 is assembled, the elongated portion 78 of the driver 70 extends through the aperture 58 of the tube 52, and the driver 70 is free to rotate with respect to the tube 52. The enlarged end portion 80 of the driver 70 includes a biasing member receiving aperture 82. As best seen in FIGS. 12 and 13, the illustrated biasing member 72 is a torsion spring that includes an inner end portion 86 and an outer end portion 88. The inner end portion 86 is received by the biasing member receiving aperture 82 of the driver 70 to directly couple the spring 72 to the driver 70. The outer end portion 88 of the spring 72 extends into an aperture 89 in the exterior spindle 34 and is thereby directly coupled to the exterior spindle 34. The spring 72 rotationally biases the driver 70 with respect to the spindle 34 about an axis 90 of the driver 70 in a direction indicated by an arrow 91 of FIG. 13.

Figure 8:
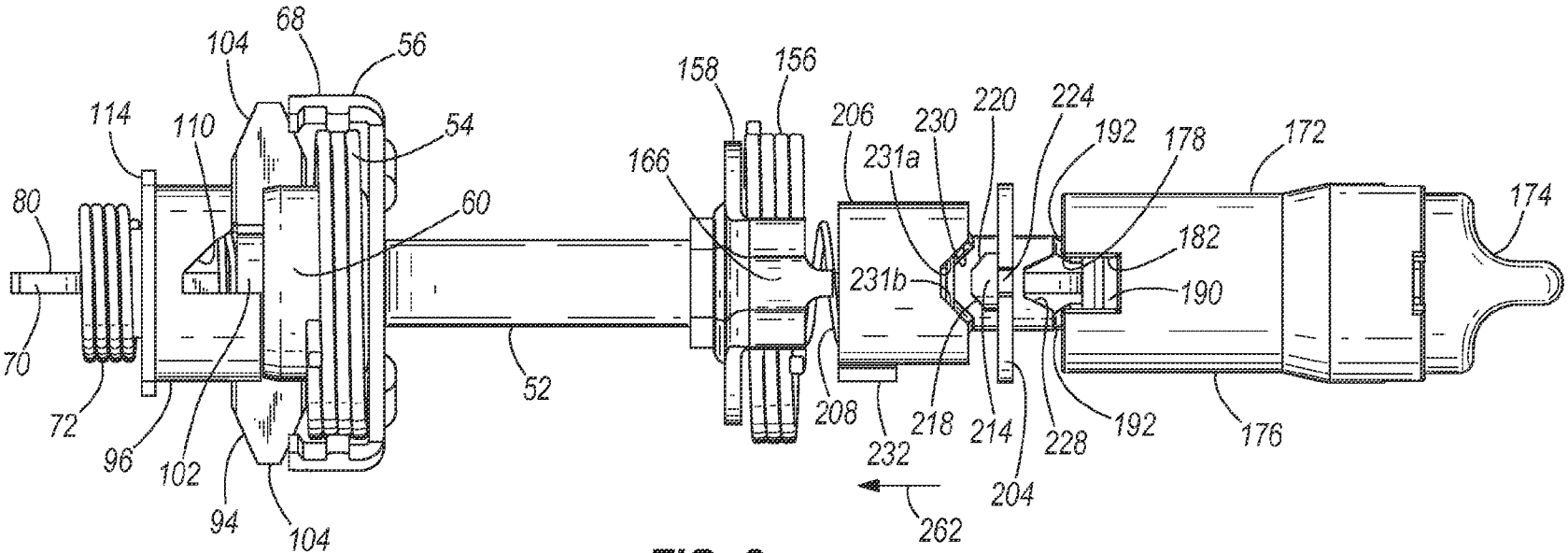
FIG. 8 is a side view of a portion of the lock assembly of FIG. 1 illustrating the lock assembly in an unlocked configuration.

Referring to FIG. 2, the exterior assembly 22 further includes an exterior handle locking assembly 92. The exterior handle locking assembly 92 includes an exterior handle locking member 94, a cam member 96, a washer 98, and a biasing member or spring 100. The exterior handle locking member 94 defines a half cylinder portion 102 and includes projections or ears 104. When the exterior assembly 22 is assembled (as best seen in FIG. 8), the half cylinder portion 102 of the exterior handle locking member 94 partially surrounds the driver 70. The exterior handle locking member 94 is able to translate with respect to the driver 70 (comparing FIGS. 8 and 9) while the driver 70 generally does not rotate the exterior handle locking member 94 (i.e., the driver 70 rotates with respect to the exterior handle locking member 94).

Referring to FIG. 2, the cam member 96 includes cam ramps 110 that correspond to respective ears 104 of the handle locking member 94. Thus, as will be discussed in more detail below, when the exterior assembly 22 is assembled, each ear 104 will travel along a respective ramp 110 of the cam member 96. The cam member 96 further includes a cam member aperture 112. The cam member aperture 112 is generally rectangular in shape and complements the cross-sectional shape of the elongated portion 78 of the driver 70. Therefore, the cam member aperture 112 couples the cam member 96 to the driver 70 such that the cam member 96 rotates with the driver 70 yet the cam member 96 is able to move along the driver 70.

The spring 100 of the exterior handle locking assembly 92 is a coil spring in the illustrated construction. When the exterior assembly 22 is assembled, the spring 100 is partially received in the hollow end portion 60. The spring 100 acts against a flange 113 defined by the hollow end portion 60 of the tube 52 and against the washer 98 to bias the exterior handle locking member 94 along the driver 70. A cam support plate 114 is utilized to support the cam member 96 against the force of the spring 100. The cam support plate 114 includes projections 115. The projections 115 are received by longitudinal slots 116 of the exterior spindle 34 to couple the cam support plate 114 to the spindle 34 for co-rotation with the spindle 34.

It should be understood that the illustrated exterior handle 30 is just one possible construction of the exterior handle 30 and in other constructions the exterior handle may take other suitable forms, such as conventional round knobs, levers, and the like.

Figure 3:
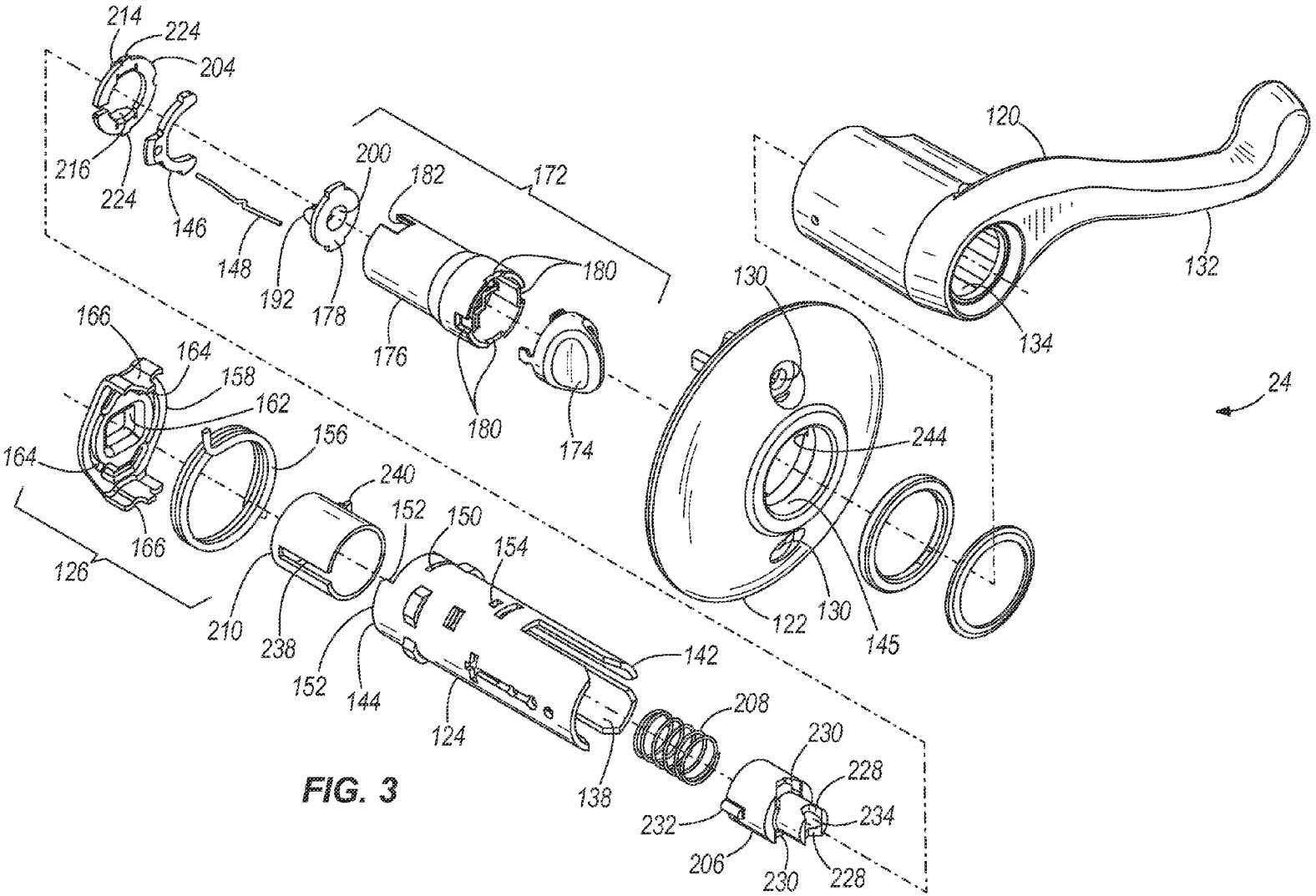
FIG. 3 is an exploded view of an interior assembly of the lock assembly of FIG. 1.

Referring to FIG. 3 the interior assembly 24 includes an interior handle 120, an interior chassis 122, an interior spindle 124, and an interior latch retractor assembly 126. The interior chassis 122 includes apertures 130 that receive fasteners (not illustrated) that extend into the apertures 42 of the exterior chassis 32 (FIG. 2) to couple the interior chassis 122 to the door and to the exterior assembly 22.

The illustrated interior handle 120 includes a handle portion 132 and an aperture 134. It should be understood that the illustrated interior handle 120 is just one possible construction of the interior handle, and in other constructions the interior handle may take other suitable forms, such as conventional round knobs, levers, and the like.

The interior spindle 124 is generally cylindrical and defines a spindle aperture 138. The interior spindle 124 includes a first or outer end portion 142 and a second or inner end portion 144. When the interior assembly 24 is assembled, the spindle 124 extends through a central aperture 145 of the interior chassis 122, and the outer end portion 142 of the spindle 124 is received within the aperture 134 of the interior handle 120. As would be understood by one of skill in the art, a clip 146 and a clip biasing member 148 are utilized to couple the interior handle 120 to the interior spindle 124 such the interior handle 120 rotates the interior spindle 124.

The inner end portion 144 of the interior spindle 124 includes a semi-circumferential slot 150 and arcuate latch retractor protections 152. While only a portion of the slot 150 is visible in FIG. 3, the slot 150 extends about 180 degrees around the circumference of the interior spindle 124. The purpose of the slot 150 will be discussed in more detail below. The interior spindle 124 further includes cam coupling apertures 154 that will also be discussed in more detail below.

The interior latch retractor assembly 126 includes an interior handle biasing member or spring 156 and an interior latch retractor 158. The latch retractor 158 includes a tube receiving aperture 162, spindle receiving apertures 164, and projections 166. The tube receiving aperture 162 has a shape that is complimentary to the end portion 63 of the tube 52 (FIG. 2) and is sized such that the end portion of the tube 52 can extend through the tube receiving aperture 162 yet rotation of the latch retractor 158 rotates the tube 52.

The arcuate spindle receiving apertures 164 partially surround the tube receiving aperture 162. The spindle receiving apertures 164 of the latch retractor 158 have a shape that is complimentary to the arcuate latch retractor projections 152 of the spindlel 24. Therefore, as best seen in FIG. 7*c*, the latch retractor projections 152 are received by the arcuate apertures 164 such that rotation of the interior spindle 124 produces a corresponding rotation of the latch retractor 158. As would be understood by one of skill in the art, the interior handle spring 156 is directly coupled to the interior chassis 122 and to the interior latch retractor 158 using the projections 166 to rotationally bias the interior handle 120 to the position illustrated in FIG. 1.

Figure 4:
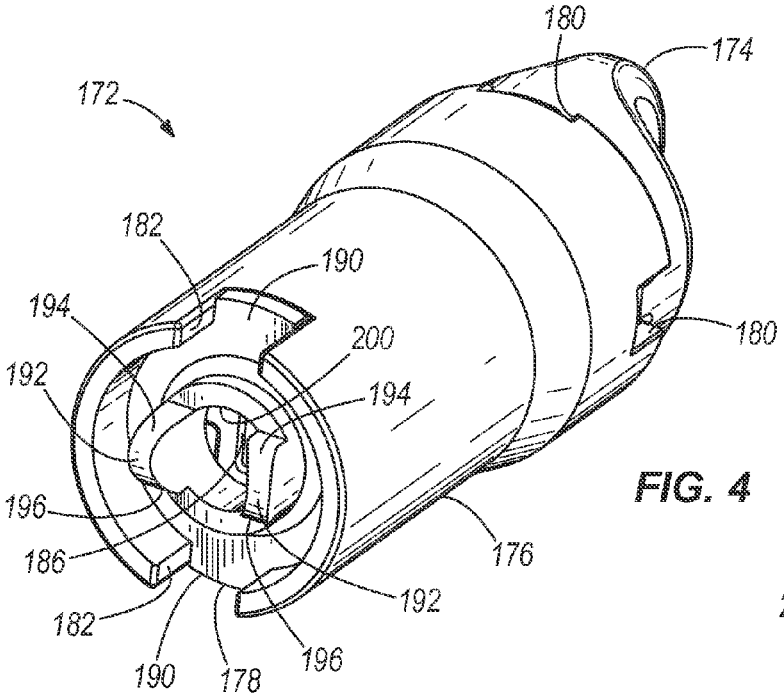
FIG. 4 is a perspective view of a locking member of the interior assembly of FIG. 3.

Referring to FIGS. 3 and 4, the interior assembly 24 further includes a locking member 172. The locking member 172 includes a turn button 174, a body portion 176, and an engagement member 178. The body portion 176 includes turn button coupling apertures 180 and notches 182 to couple the turn button 174 and the engagement member 178, respectively, to the body portion 176 for rotation with the body portion 176. As seen in FIG. 4, the body portion 176 further includes a driver receiving aperture 186 that receives the driver 70 (FIG. 1) such that the driver 70 and the locking member 172 are coupled for co-rotation.

With continued reference to FIG. 4, the engagement member 178 includes tabs 190 that extend into respective notches 182 to couple the engagement member 178 to the body portion 176 of the locking member 172. The engagement member 178 includes cam projections 192 that each include a first or upwardly facing cam surface 194 and a second or downwardly facing cam surface 196. The engagement member 178 defines an aperture 200 through which the driver 70 extends when the lock assembly 20 is assembled.

Referring to FIGS. 3 and 7*a*-7*c*, the interior assembly 24 further includes a cam member 204, a coupling 206, a coupling biasing member or spring 208, and a fixed tube 210. As best seen in FIG. 7*d*, the cam member 204 includes a first or upper cam projection 214 and a second or lower cam projection 216. Both of the cam projections 214, 216 include cam surfaces 218, 220. The cam member 204 further includes spindle coupling tabs 224 that are received by the cam coupling apertures 154 of the interior spindle 124 (see FIG. 7*c*) to couple the cam member 204 to the interior spindle 124 within the spindle aperture 138. Therefore, rotation of the interior spindle 124, which is caused by rotation of the interior handle 120, causes a corresponding rotation of the cam member 204.

Figure 5:
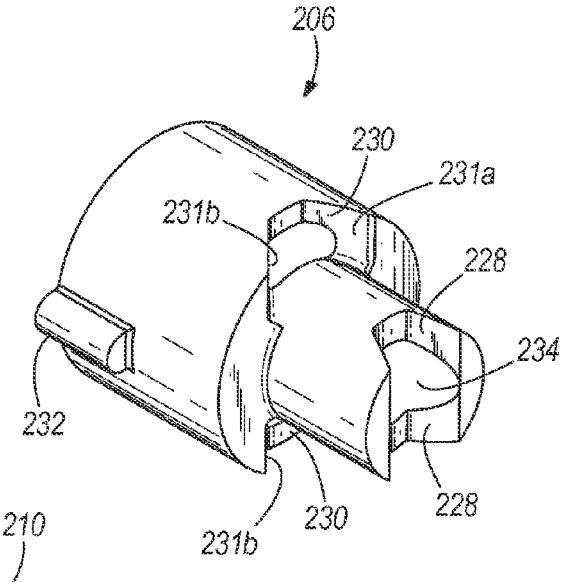
FIG. 5 is a perspective view of a coupling of the interior assembly of FIG. 3.

Referring to FIGS. 3 and 5, the coupling 206 includes locking member receiving recesses 228 and cam member receiving recesses 230. As best seen in FIG. 5, the cam member receiving recesses 230 both define cam surfaces 231*a* and 231*b*. The coupling further includes an elongated projection 232 and the coupling 206 defines an aperture 234 that extends longitudinally through the coupling 206. The inner dimensions of the aperture 234 are large enough such that the driver 70 (FIG. 2) extends through and rotates with respect to the coupling 206.

Figure 6:
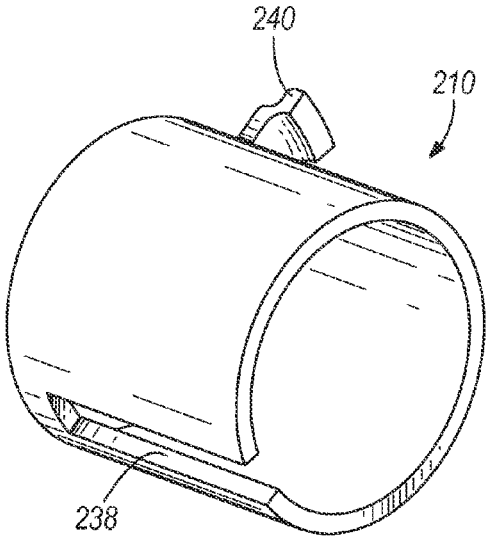
FIG. 6 is a perspective view of a tube member of the interior assembly of FIG. 3.

Referring to FIGS. 3 and 6, the fixed tube 210 is a generally tubular member that includes a coupling projection slot 238 and a chassis coupling projection 240.

Figure 7A:
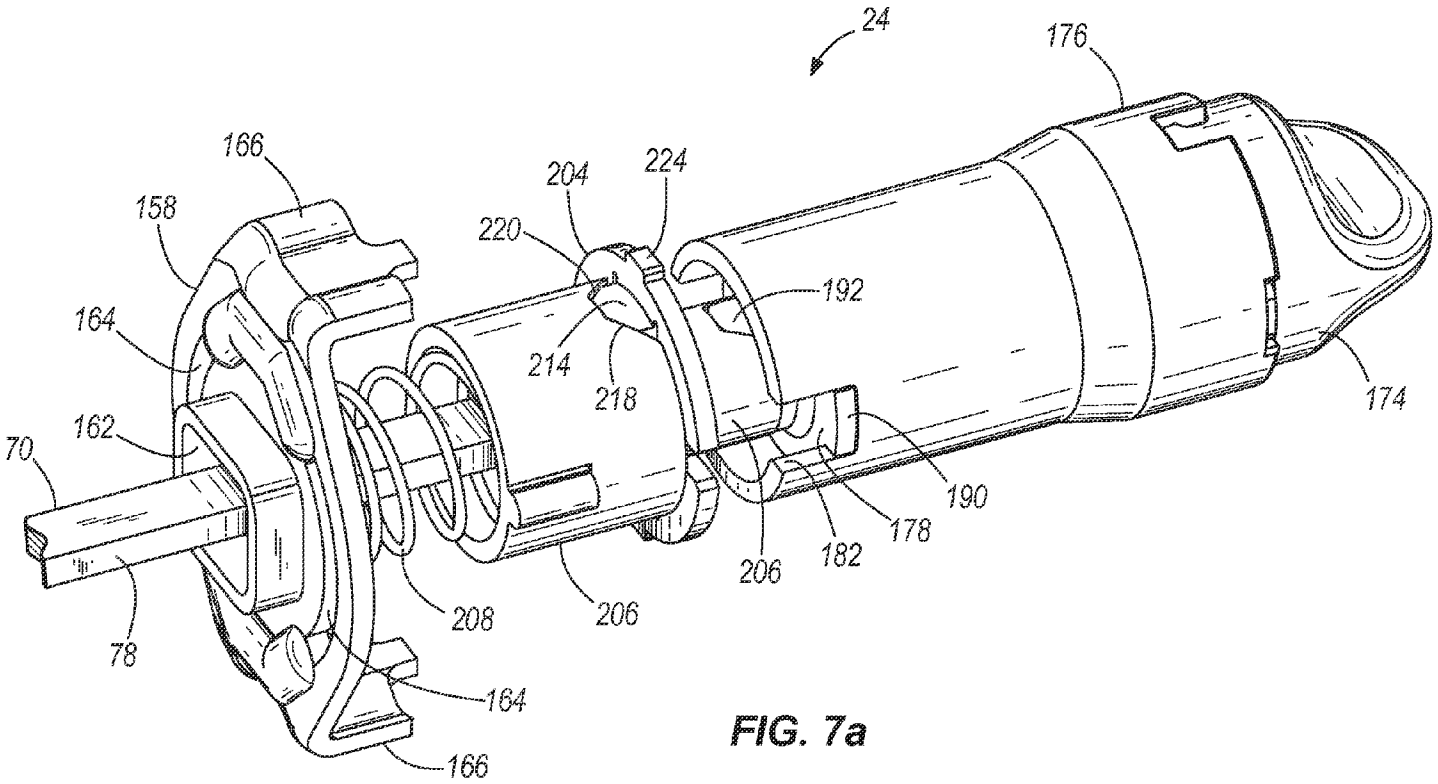
FIGS. 7*a*-7*c* are perspective views of the interior assembly of the lock assembly of FIG. 1 with portions of the interior assembly removed.
Figure 7B:
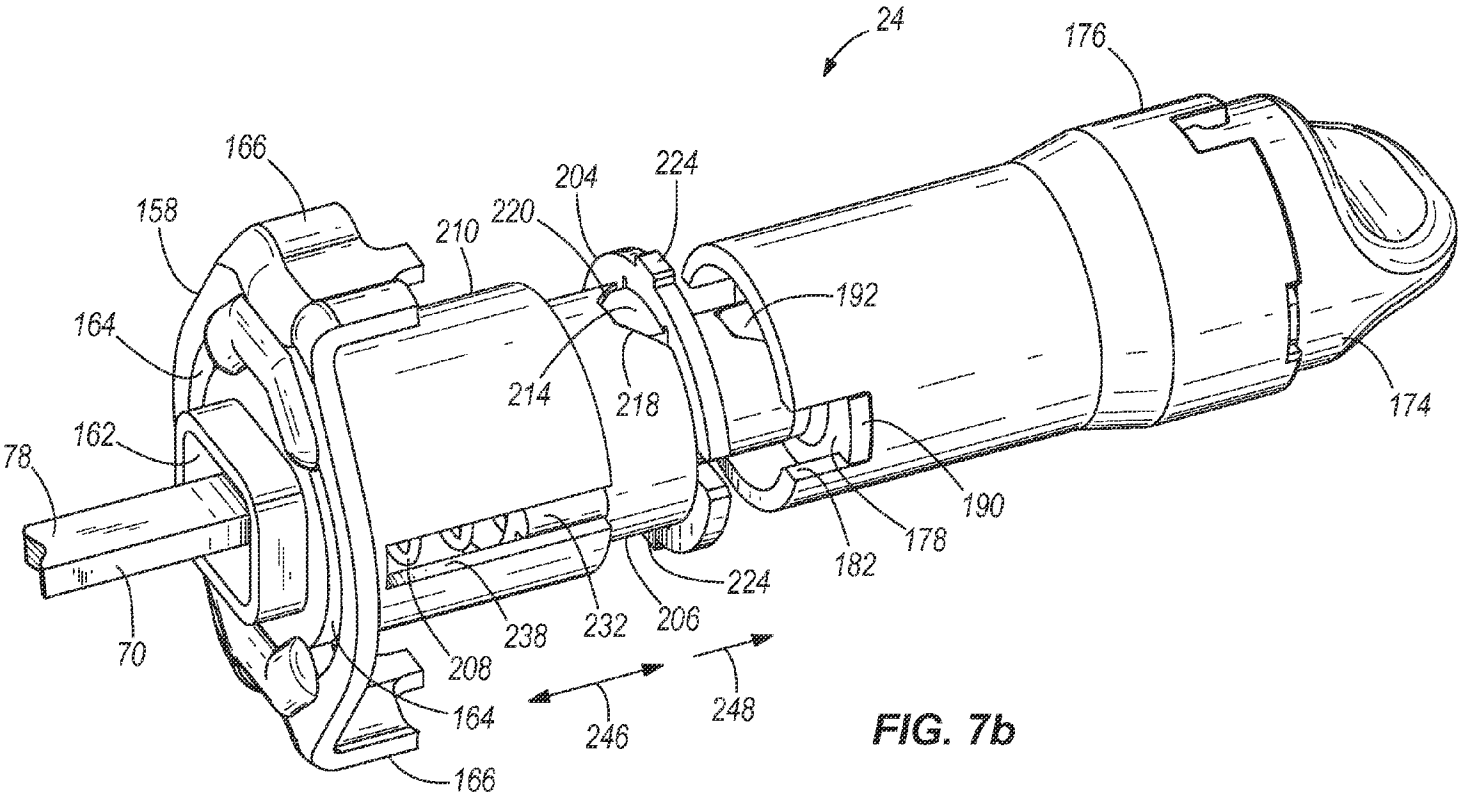
Figures 7C, 7D:
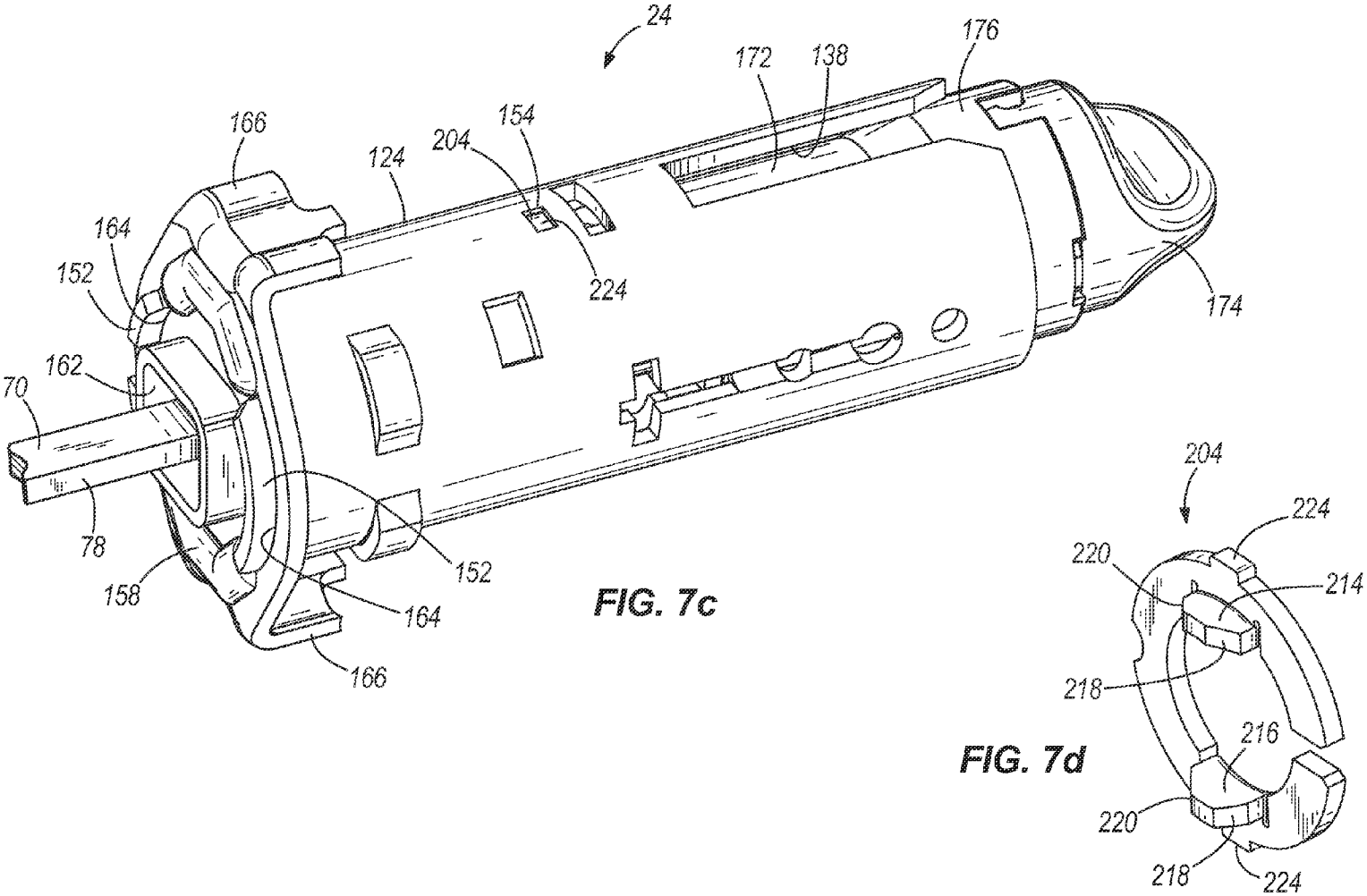
FIG. 7*d* is a perspective view of a cam member of the interior lock assembly of FIG. 1.

Referring to FIGS. 3 and 7*b*, the interior assembly 24 is assembled such that the coupling 206 is received within the fixed tube 210 (see FIG. 7*b*). The projection 232 of the coupling 206 is received within the coupling projection slot 238 of the fixed tube 210. While not visible in FIG. 7*b*, the chassis coupling projection 240 of the fixed tube 210 is received by a recess 244 (see FIG. 3) in the interior chassis 122, thereby substantially preventing rotational and longitudinal movement of the fixed tube 210 with respect to the chassis 122. Because the fixed tube 210 is substantially prevented from rotating, the coupling 206 is also prevented from rotating because the projection 232 of the coupling 206 is received within the coupling projection slot 238. However, the coupling 206 is allowed to move longitudinally in the direction indicated by the arrows 246 of FIG. 7*b* and such movement is guided by the coupling projection 232 and the coupling projection slot 238. The spring 208 acts against the interior latch retractor 158, which is longitudinally fixed, and the coupling 206, thereby biasing the coupling 206 in the direction of the arrow 248 (FIG. 7*b*).

Referring to FIG. 1, the latch assembly 26 is a conventional latch assembly utilized in tubular locks and is generally known in the art. The latch assembly 26 includes a latch 252 and a latch actuator 254. The latch actuator 254 defines a substantially square or rectangular aperture 255. When the lock assembly 20 is assembled, the aperture 255 of the latch actuator 254 receives the square portion 63 of the tube 52 such that rotation of the tube 52 rotates the latch actuator 254. As would be understood by one of skill in the art, rotation of the latch actuator 254 retracts the latch 252.

In operation, referring to FIGS. 1 and 8, when the locking member 172 is in the unlocked position, as illustrated in FIG. 8, a user can manually rotate either the interior handle 120 or the exterior handle 30 to retract the latch 252. Rotation of the exterior handle 30 rotates the exterior spindle 34 (FIG. 2) that rotates the exterior latch retractor 56 to rotate the tube 52. Rotation of the tube 52, which is engaged with the latch actuator 254, retracts the latch 252. When the latch 252 is retracted, the user is able to open the door. Similarly, rotation of the interior handle 120 rotates the interior spindle 124 (FIG. 3) that rotates the interior latch retractor 158, thereby rotating the tube 52 to retract the latch 252.

Referring to FIGS. 3 and 7*b*, while the fixed tube 210 is substantially fixed with respect to the interior chassis 122, the semi-circumferential slot 150 formed in the interior spindle 124 allows the interior spindle 124 to rotate with respect to the fixed tube 210. Furthermore, because the semi-circumferential slot 150 extends approximately 180 degrees around the circumference of the interior spindle 124, the interior spindle 124 and handle 120 can rotate approximately 90 degrees in either the clockwise or counterclockwise directions to retract the latch 252.

Figure 9:
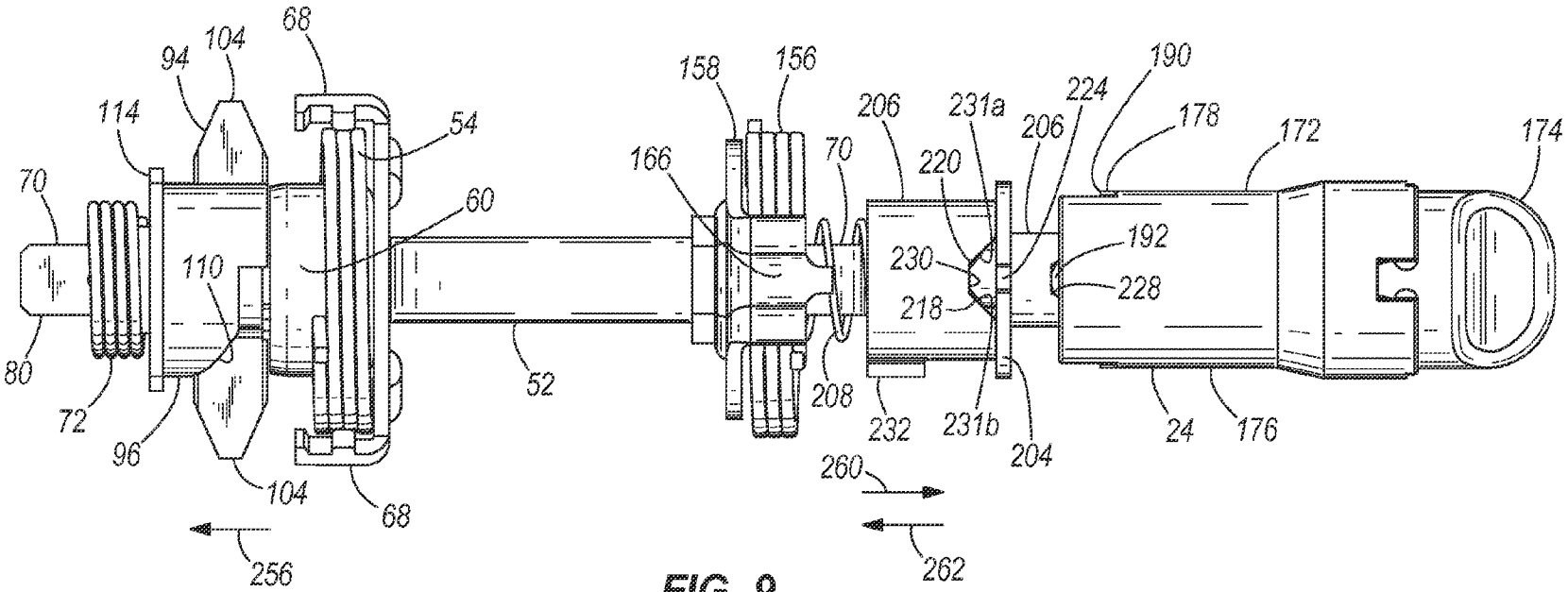
FIG. 9 is a side view of a portion of the lock assembly of FIG. 1 illustrating the lock assembly in a locked configuration.

Referring to FIG. 9, to lock the lock assembly 20, the driver 70 is rotated approximately 90 degrees from the unlocked position illustrated in FIG. 8. The driver 70 is rotated to the locked position by rotating the locking member 172, which rotates the driver 70. Additionally, while not illustrated, as would be understood by one of skill in the art, the driver 70 can also be rotated by inserting a key into the exterior assembly 22 (FIG. 1) and rotating the key to rotate the driver 70.

Figure 14:
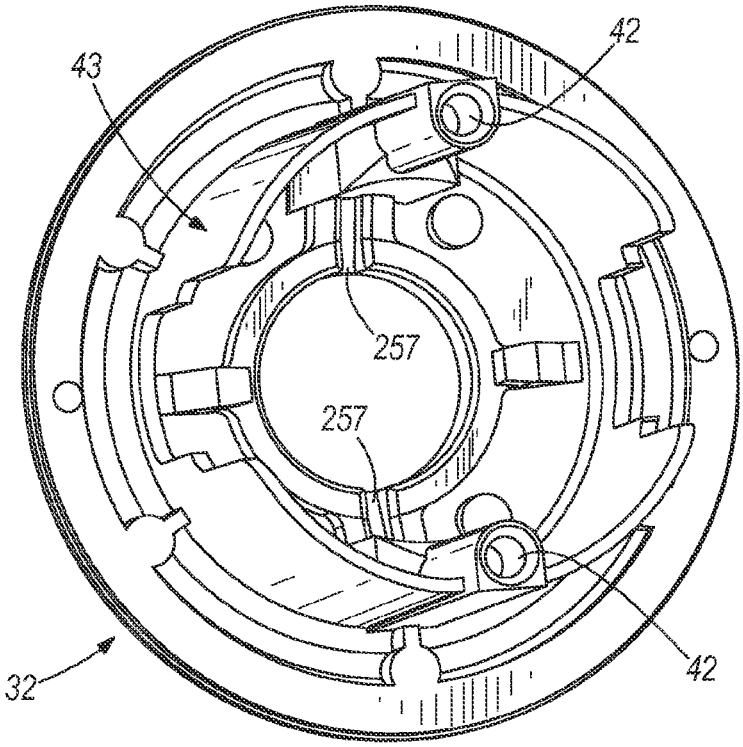
FIG. 14 is a perspective view of a chassis of the exterior assembly.

Referring to FIGS. 2, 8, and 9, when the driver 70 is rotated from the position illustrated in FIG. 8 (unlocked) to the position illustrated in FIG. 9 (locked), the exterior handle locking member 94 moves in the direction of the arrow 256 of FIG. 9 as a result of the bias exerted on the exterior handle locking member 94 by the spring 100. When the driver 70 is rotated from the unlocked position (FIG. 8) to the locked position (FIG. 9) the cam member 96 rotates with the driver 70 and the spring 100 (FIG. 2) moves the exterior handle locking member 94 in the direction of the arrow 256 and down the cam ramps 110 of the cam member 96. The ears 104 of the exterior handle locking member 94 extend through the slots 116 of the spindle 34 (FIG. 2) when the exterior assembly 22 is assembled and the ears 104 are sized such that the exterior handle locking member 94 can move longitudinally with respect to the spindle 34. When the exterior handle locking member 94 is in the locked position as illustrated in FIG. 9, the ears 104 of the exterior handle locking member 94 extend through the slots 116 of the spindle 34 (FIG. 2) and are received in slots 257 (see FIG. 14) of the exterior chassis 32 to interconnect the exterior spindle 34 and the exterior chassis 32. The interconnection of the exterior spindle 34 and the exterior chassis 32 by the locking member 94 substantially prevents rotation of the exterior spindle 34 with respect to the exterior chassis 32. Because the exterior handle 30 is coupled for rotation with the exterior spindle 34, if the exterior spindle 34 is prevented from substantially rotating, the user is unable to rotate the exterior handle 30 to retract the latch 252 and open the door. Therefore, when the locking member 94 is in the locked position, the user is unable to rotate the exterior handle 30 to retract the latch 252.

Referring to FIGS. 1, 8, and 9, the driver spring 72 rotationally biases the driver 70 to the unlocked position (FIG. 8). Therefore, the driver 70 has a natural tendency to rotate from the locked position back to the unlocked position of FIG. 8. When the driver 70 rotates from the locked position (FIG. 9) to the unlocked position (FIG. 8), the cam member 96 rotates with the driver 70. Rotation of the cam member 96 causes the exterior handle locking member 94 to move up along the cam ramps 110 of the cam member 96 thereby forcing the exterior handle locking member 94 to move along the driver 70, back to the unlocked position of FIG. 8. When the exterior handle locking member 94 is in the unlocked position (FIG. 8) the exterior handle locking member 94 does not interconnect the exterior spindle 34 and the exterior chassis 32 (FIG. 1) and therefore the exterior spindle 34 (and exterior handle 30) are rotatable to retract the latch 252 (FIG. 1) and open the door.

Figure 10:
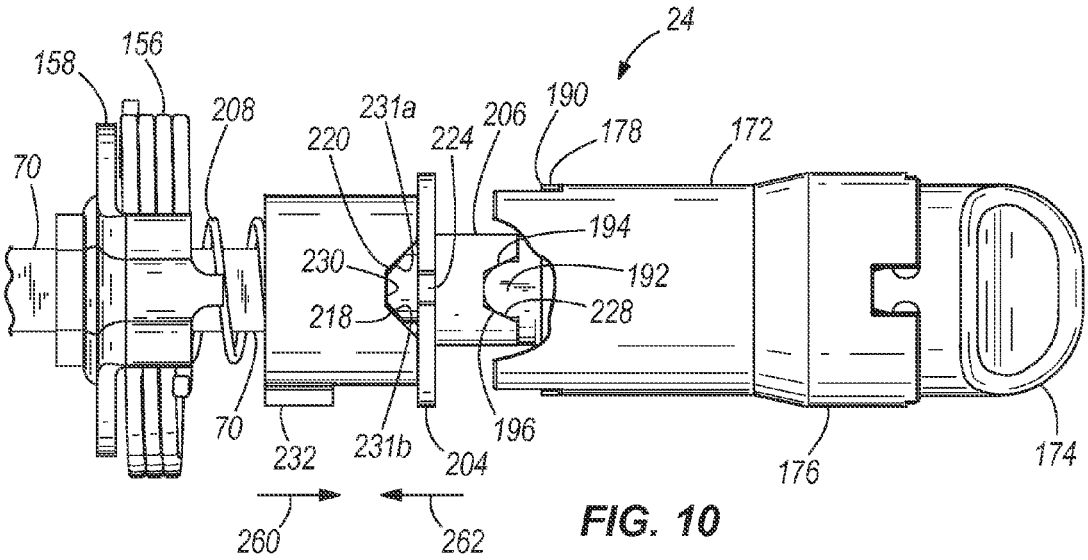
FIG. 10 is a side view of a portion of the interior assembly of the lock assembly of FIG. 1 in the locked configuration.

Referring to FIGS. 9 and 10, in order to prevent unwanted rotation of the driver 70 from the locked position to the unlocked position, the locking member 172 of the interior assembly 24 retains the driver 70 in the locked position of FIG. 9. As best seen in FIG. 10, the projections 192 of the locking member 172 engage the recesses 228 of the coupling 206. As discussed above, the locking member 172 is rotationally fixed with respect to the driver 70 and the coupling 206 is prevented from rotating with respect to the chassis 122. The coupling spring 208, which biases the coupling 206 in the direction of the arrow 260 of FIGS. 9 and 10, biases the coupling 206 into engagement with the locking member 172. Thus, the coupling 206 retains the driver 70 and the locking member 172 in the locked position illustrated in FIGS. 9 and 10.

Figure 11:
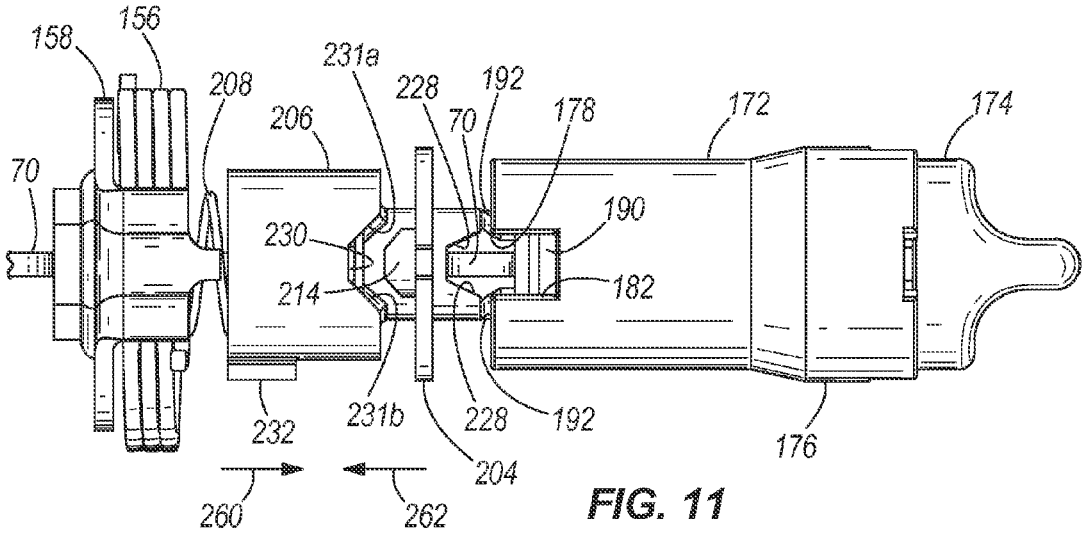
FIG. 11 is a side view of a portion of the interior assembly of the lock assembly of FIG. 1 in the unlocked configuration.

Referring to FIGS. 1, 10 and 11, to unlock the lock assembly 20 the user can manually rotate the turn button 174 of the locking member 172 from the locked position (FIG. 10) to the unlocked position (FIG. 11). When the user rotates the turn button 174 from the locked position to the unlocked position, the projections 192 of the locking member 172 cam against the recesses 228 of the coupling 206 and the coupling is forced to move in the direction of the arrow 262 of FIG. 11 against the bias of the coupling spring 208. With the projections 192 disengaged from the recesses 228, the user is able to rotate the turn button 174 and driver 70 to the unlocked position. As discussed above, the driver spring 72 (FIG. 8) biases the driver 70 to the unlocked position to retain the driver 70 in the unlocked position.

While not illustrated, but as would be understood by one of skill in the art, the user can also rotate the driver 70 from the locked position to the unlocked position using a key. The user can rotate the key approximately 90 degrees to rotate the driver 70 from the locked position to the unlocked position. Similar to rotating the turn button 174, when the user rotates the driver 70 using a key, the driver 70 and locking member 172 are rotated to disengage the projections 192 of the locking member 172 from the recesses 228 of the coupling 206. After rotating the driver 70 to the unlocked position using a key, further rotation of the key allows the user to retract the latch 252.

Referring to FIGS. 1, 8, and 9, when the lock assembly 20 is in the locked position (FIG. 9) the user can also unlock the lock assembly 20 by rotating the interior handle 120 in either the clockwise or counterclockwise directions. Rotation of the interior handle 120 rotates the cam member 204, and rotation of the cam member 204 causes either the cam surfaces 218 or 220 (depending on whether the handle 120 is rotated clockwise or counterclockwise) to cam against the corresponding cam surfaces 231*a* or 231*b* of the coupling 206 thereby forcing the coupling 206 to move in the direction of the arrow 262 of FIG. 9 against the bias of the coupling spring 208. As the coupling 206 moves in the direction of the arrow 262, the projections 192 of the locking member 172 disengage from the recesses 228 of the coupling 206. As the coupling 206 and locking member 172 begin to disengage, the driver spring 72 moves the driver 70 and locking member 172 from the locked position (FIG. 9) to the unlocked position (FIG. 8). Meanwhile, continued rotation of the interior handle 120 allows the user to retract the latch 252 to open the door. Therefore, the user can open the door when the lock assembly 20 is locked (i.e., 'emergency egress') and the lock assembly 20 becomes unlocked when the user rotates the interior handle 120 to retract the latch, thereby providing a non-lockout feature.

Various features and advantages of the invention are set forth in the following claims.

What is claimed is:

1. A lock assembly for use with a latch movable from an extended position to a retracted position, the lock assembly comprising:

an interior assembly including, an interior handle manually movable to retract the latch, a locking member manually operable such that the locking member is movable from an unlocked position to a locked position, an exterior assembly including, an exterior handle manually operable to retract the latch when the locking member is in the unlocked position and inoperable to retract the latch when the locking member is in the locked position, and a biasing member that biases the locking member toward the unlocked position, and wherein when the locking member is in the locked position, movement of the interior handle to retract the latch causes the biasing member to move the locking member to the unlocked position, wherein the interior assembly further includes a coupling that when the locking member is in the locked position retains the locking member in the locked position against the bias of the biasing member, and wherein movement of the interior handle to retract the latch disengages the coupling and the locking member to allow the locking member to move into the unlocked position, wherein the interior assembly further includes a coupling biasing member that biases the coupling towards the locking member.

2. The lock assembly of claim 1, wherein the interior assembly includes a cam member rotatably coupled to the interior handle, and wherein when the locking member is in the locked position, movement of the interior handle to retract the latch rotates the cam member to produce a corresponding translational movement of the coupling to disengage the coupling from the locking member.

3. The lock assembly of claim 2, wherein the interior handle is rotatable in a first direction and a second direction to retract the latch, wherein the cam member includes a first cam surface and a second cam surface such that the interior handle can be rotated in the first and second directions to disengage the coupling from the locking member.

4. The lock assembly of claim 1, further comprising a driver that extends from the interior assembly to the exterior assembly, the driver coupled for rotation with the locking member, and wherein the biasing member is directly coupled to the driver.

5. The lock assembly of claim 4, wherein the exterior assembly further includes a spindle coupled for rotation with the exterior handle to facilitate retracting the latch, wherein the biasing member is a torsion spring that includes a first end portion and a second end portion, and wherein the first end portion is directly coupled to the driver and the second end portion is directly coupled to the spindle.

6. The lock assembly of claim 5, wherein the exterior assembly is configured to receive a key such that rotation of the key rotates the driver from the locked position to the unlocked position and further rotation of the key moves the latch from the extended position to the refracted position.

7. The lock assembly of claim 1, wherein the locking member includes a portion that extends from the interior handle.

8. The lock assembly of claim 1, wherein the biasing member is a torsion spring.

9. A lock assembly for use with a latch movable from an extended position to a refracted position, the lock assembly comprising:

an interior assembly including, an interior handle manually operable to retract the latch, a turn button manually rotatable with respect to the handle from a locked position to an unlocked position, an exterior assembly including an exterior handle manually operable to retract the latch when the turn button is in the unlocked position and inoperable to retract the latch when the turn button is in the locked position, and wherein when the turn button is in the locked position movement of the interior handle to retract the latch causes the turn button to move to the unlocked position; and a latch actuator including a first portion coupled to the interior handle to rotate with the interior handle to retract the latch and a second portion coupled to the exterior handle to rotate with the exterior handle to retract the latch, wherein the first portion of the latch actuator is coupled to the second portion of the latch actuator such that the first portion of the latch actuator is fixed from movement relative to the second portion of the latch actuator, further comprising, a biasing member that biases the turn button toward the unlocked position, and wherein when the turn button is in the locked position, movement of the interior handle to retract the latch causes the biasing member to rotate the turn button to the unlocked position, and a driver that extends from the interior assembly to the exterior assembly, the driver coupled for rotation with the locking member, and wherein the biasing member is directly coupled to the driver.

10. The lock assembly of claim 9, wherein the biasing member is a torsion spring.

11. The lock assembly of claim 9, wherein the interior assembly further includes a coupling that when the locking member is in the locked position retains the locking member in the locked position against the bias of the biasing member, and wherein movement of the interior handle to retract the latch disengages the coupling and the locking member to allow the locking member to move into the unlocked position.

12. The lock assembly of claim 11, wherein the interior assembly includes a cam member rotatably coupled to the interior handle, and wherein when the locking member is in the locked position, movement of the interior handle to retract the latch rotates the cam member to produce a corresponding translational movement of the coupling to disengage the coupling from the locking member.

13. The lock assembly of claim 11, wherein the interior assembly further includes a coupling biasing member that biases the coupling towards the locking member.

14. A lock assembly for use with a latch movable from an extended position to a retracted position, the lock assembly comprising:

an interior assembly including, an interior handle manually operable to retract the latch, a locking member manually operable such that the locking member is movable from an unlocked position and a locked position, an exterior assembly including an exterior handle manually operable to retract the latch when the locking member is in the unlocked position and inoperable to retract the latch when the locking member is in the locked position; and a torsion spring that biases the locking member toward the unlocked position, and wherein when the locking member is in the locked position, movement of the interior handle to retract the latch causes the torsion spring to rotate the locking member to the unlocked position.

15. The lock assembly of claim 14, wherein the interior assembly further includes a coupling that when the locking member is in the locked position retains the locking member in the locked position against the bias of the torsion spring, and wherein movement of the interior handle to retract the latch disengages the coupling and the locking member to allow the locking member to move into the unlocked position.

16. The lock assembly of claim 15, wherein the interior assembly includes a cam member rotatably coupled to the interior handle, and wherein when the locking member is in the locked position, movement of the interior handle to retract the latch rotates the cam member to produce a corresponding translational movement of the coupling to disengage the coupling from the locking member.

17. The lock assembly of claim 15, wherein the interior assembly further includes a coupling biasing member that biases the coupling towards the locking member.

18. The lock assembly of claim 14, further comprising a driver that extends from the interior assembly to the exterior assembly, the driver coupled for rotation with the locking member, and wherein the torsion spring is directly coupled to the driver.

19. The lock assembly of claim 14, wherein the locking member includes a portion that extends from the interior handle.

20. A lock assembly for use with a latch movable from an extended position to a retracted position, the lock assembly comprising:

an interior assembly including, an interior handle manually movable to retract the latch, a locking member manually operable such that the locking member is movable from an unlocked position to a locked position, an exterior assembly including, an exterior handle manually operable to retract the latch when the locking member is in the unlocked position and inoperable to retract the latch when the locking member is in the locked position, and a biasing member that biases the locking member toward the unlocked position, and wherein when the locking member is in the locked position, movement of the interior handle to retract the latch causes the biasing member to move the locking member to the unlocked position, wherein the interior assembly further includes a coupling that when the locking member is in the locked position retains the locking member in the locked position against the bias of the biasing member, and wherein movement of the interior handle to retract the latch disengages the coupling and the locking member to allow the locking member to move into the unlocked position, wherein the interior assembly includes a cam member rotatably coupled to the interior handle, and wherein when the locking member is in the locked position, movement of the interior handle to retract the latch rotates the cam member to produce a corresponding translational movement of the coupling to disengage the coupling from the locking member.

21. The lock assembly of claim 20, wherein the interior handle is rotatable in a first direction and a second direction to retract the latch, wherein the cam member includes a first cam surface and a second cam surface such that the interior handle can be rotated in the first and second directions to disengage the coupling from the locking member.

22. A lock assembly for use with a latch movable from an extended position to a retracted position, the lock assembly comprising:

an interior assembly including, an interior handle manually movable to retract the latch, a locking member manually operable such that the locking member is movable from an unlocked position to a locked position, an exterior assembly including, an exterior handle manually operable to retract the latch when the locking member is in the unlocked position and inoperable to retract the latch when the locking member is in the locked position, and a biasing member that biases the locking member toward the unlocked position, and wherein when the locking member is in the locked position, movement of the interior handle to retract the latch causes the biasing member to move the locking member to the unlocked position, wherein the interior assembly further includes a coupling that when the locking member is in the locked position retains the locking member in the locked position against the bias of the biasing member, and wherein movement of the interior handle to retract the latch disengages the coupling and the locking member to allow the locking member to move into the unlocked position, further comprising a driver that extends from the interior assembly to the exterior assembly, the driver coupled for rotation with the locking member, and wherein the biasing member is directly coupled to the driver.

23. The lock assembly of claim 22, wherein the exterior assembly further includes a spindle coupled for rotation with the exterior handle to facilitate retracting the latch, wherein the biasing member is a torsion spring that includes a first end portion and a second end portion, and wherein the first end portion is directly coupled to the driver and the second end portion is directly coupled to the spindle.

24. The lock assembly of claim 23, wherein the exterior assembly is configured to receive a key such that rotation of the key rotates the driver from the locked position to the unlocked position and further rotation of the key moves the latch from the extended position to the refracted position.

25. A lock assembly for use with a latch movable from an extended position to a retracted position, the lock assembly comprising:

an interior assembly including, an interior handle manually operable to retract the latch, a turn button manually rotatable with respect to the handle from a locked position to an unlocked position, an exterior assembly including an exterior handle manually operable to retract the latch when the turn button is in the unlocked position and inoperable to retract the latch when the turn button is in the locked position, and wherein when the turn button is in the locked position movement of the interior handle to retract the latch causes the turn button to move to the unlocked position; and a latch actuator including a first portion coupled to the interior handle to rotate with the interior handle to retract the latch and a second portion coupled to the exterior handle to rotate with the exterior handle to retract the latch, wherein the first portion of the latch actuator is coupled to the second portion of the latch actuator such that the first portion of the latch actuator is fixed from movement relative to the second portion of the latch actuator, further comprising a biasing member that biases the turn button toward the unlocked position, and wherein when the turn button is in the locked position, movement of the interior handle to retract the latch causes the biasing member to rotate the turn button to the unlocked position, and wherein the biasing member is a torsion spring.

26. A lock assembly for use with a latch movable from an extended position to a retracted position, the lock assembly comprising:

an interior assembly including, an interior handle manually operable to retract the latch, a turn button manually rotatable with respect to the handle from a locked position to an unlocked position, an exterior assembly including an exterior handle manually operable to retract the latch when the turn button is in the unlocked position and inoperable to retract the latch when the turn button is in the locked position, and wherein when the turn button is in the locked position movement of the interior handle to retract the latch causes the turn button to move to the unlocked position; and a latch actuator including a first portion coupled to the interior handle to rotate with the interior handle to retract the latch and a second portion coupled to the exterior handle to rotate with the exterior handle to retract the latch, wherein the first portion of the latch actuator is coupled to the second portion of the latch actuator such that the first portion of the latch actuator is fixed from movement relative to the second portion of the latch actuator, further comprising a biasing member that biases the turn button toward the unlocked position, and wherein when the turn button is in the locked position, movement of the interior handle to retract the latch causes the biasing member to rotate the turn button to the unlocked position, wherein the interior assembly further includes a coupling that when the locking member is in the locked position retains the locking member in the locked position against the bias of the biasing member, and wherein movement of the interior handle to retract the latch disengages the coupling and the locking member to allow the locking member to move into the unlocked position, and wherein the interior assembly includes a cam member rotatably coupled to the interior handle, and wherein when the locking member is in the locked position, movement of the interior handle to retract the latch rotates the cam member to produce a corresponding translational movement of the coupling to disengage the coupling from the locking member.

27. A lock assembly for use with a latch movable from an extended position to a retracted position, the lock assembly comprising:

an interior assembly including, an interior handle manually operable to retract the latch, a turn button manually rotatable with respect to the handle from a locked position to an unlocked position, an exterior assembly including an exterior handle manually operable to retract the latch when the turn button is in the unlocked position and inoperable to retract the latch when the turn button is in the locked position, and wherein when the turn button is in the locked position movement of the interior handle to retract the latch causes the turn button to move to the unlocked position; and a latch actuator including a first portion coupled to the interior handle to rotate with the interior handle to retract the latch and a second portion coupled to the exterior handle to rotate with the exterior handle to retract the latch, wherein the first portion of the latch actuator is coupled to the second portion of the latch actuator such that the first portion of the latch actuator is fixed from movement relative to the second portion of the latch actuator, further comprising a biasing member that biases the turn button toward the unlocked position, and wherein when the turn button is in the locked position, movement of the interior handle to retract the latch causes the biasing member to rotate the turn button to the unlocked position, wherein the interior assembly further includes a coupling that when the locking member is in the locked position retains the locking member in the locked position against the bias of the biasing member, and wherein movement of the interior handle to retract the latch disengages the coupling and the locking member to allow the locking member to move into the unlocked position, and wherein the interior assembly further includes a coupling biasing member that biases the coupling towards the locking member.

* * * * *